US006904627B2

(12) United States Patent
Lee

(10) Patent No.: US 6,904,627 B2
(45) Date of Patent: Jun. 14, 2005

(54) SOAP CONTAINER APPARATUS

(76) Inventor: Kuon Jen Lee, c/o Susana E. Liberman Moldes 4186, Buenos Aires (AR) 1429

( * ) Notice: Subject to any disclaimer, the term of this patent is extended or adjusted under 35 U.S.C. 154(b) by 10 days.

(21) Appl. No.: 10/798,787

(22) Filed: Mar. 11, 2004

(65) Prior Publication Data

US 2005/0076434 A1 Apr. 14, 2005

(30) Foreign Application Priority Data

Oct. 9, 2003 (AR) ..... M030103687 U

(51) Int. Cl.[7] ..... A47K 3/22; E03C 1/01
(52) U.S. Cl. ..... 4/654; 4/559; 4/605
(58) Field of Search ..... 4/559, 605, 654, 4/656, 657, 661

(56) References Cited

U.S. PATENT DOCUMENTS 5,377,367 A * 1/1995 Bischoff ..... 4/605
5,678,258 A * 10/1997 Healy ..... 4/605
6,766,544 B1 * 7/2004 Lloyd et al. ..... 4/559

* cited by examiner

*Primary Examiner*—Tuan Nguyen
(74) *Attorney, Agent, or Firm*—William B. Ritchie

(57) ABSTRACT

A soap container with a lid that is designed to attached to a typical faucet that is opened and closed via a valve that is opened or closed by moving a handle a quarter of a turn. The soap container apparatus is preferably rectangular in shape having a plurality of holes at short axis end and an attachment mechanism at the other end short axis end. The plurality of holes is designed for draining the water left from the use of the soap. The attachment mechanism of the soap container is provided with a groove shaped and sized according to its insertion in the external upper section of the threaded shaft of the valve that permits said valve to opened or closed. The soap container with a lid is fixed to the faucet of the type mentioned above by a flat lid and female threaded ridge round shaped fixing element.

3 Claims, 1 Drawing Sheet

SOAP CONTAINER APPARATUS

This application claims benefit of Argentine Patent Application Ser. No. 030103687, filed Oct. 9, 2003, pursuant to 35 USC §119.

BACKGROUND OF INVENTION

1. Field of the Invention

This invention relates to personal cleansing agent holding devices, namely containers for a bar of soap.

2. Description of the Related Art

The multiple variants related to various locations for spaces designed to contain soap tablets for personal cleaning are well known in the art. These spaces, which are sometimes an integral part of the sanitary apparatus or walls; as hanging elements, etc, do not always have the property of completely draining the water residues left from the bar of soap by the users thus causing excessive costs and residues from the cleaning agent in the same container designed to contain them.

There is not found in the prior art a container for a bar of soap is configured to allow complete drainage of all residues and to prevent the soap from dropping to the floor by the user, and to protect the soap from the surrounding environment.

SUMMARY OF THE INVENTION

It is an aspect of the invention to provide a soap container apparatus that overcomes the deficiencies of the prior art containment methods noted above.

The invention is a soap container with a lid that is designed to attached to a typical faucet that is opened and closed via a valve that is opened or closed by moving a handle a quarter of a turn.

The soap container apparatus is preferably rectangular in shape having a plurality of holes at short axis end and an attachment mechanism at the other end short axis end. The plurality of holes is designed for draining the water left from the use of the soap. The attachment mechanism of the soap container is provided with a groove shaped and sized according to its insertion in the external upper section of the threaded shaft of the valve that permits said valve to opened or closed. The soap container with a lid is fixed to the faucet of the type mentioned above by a flat lid and female threaded ridge round shaped fixing element.

DETAILED DESCRIPTION OF THE INVENTION

Figure 1:
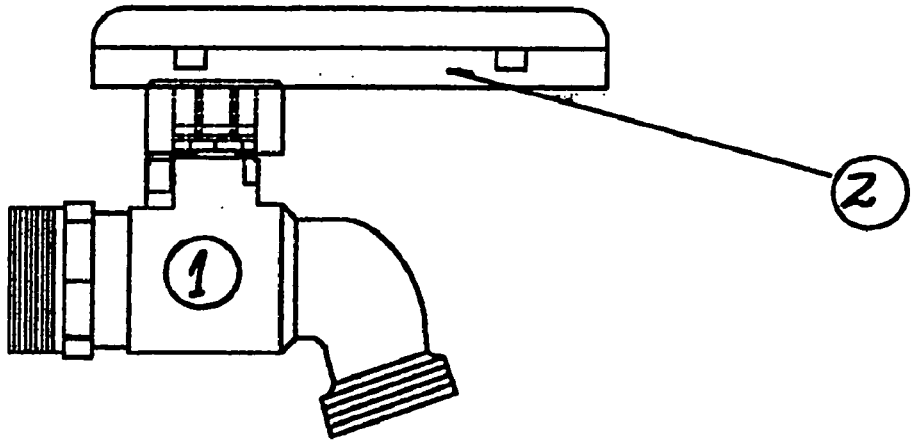
FIG. 1 illustrates a side view of the soap container apparatus attached to a valve of a faucet in accordance with the invention.

FIG. 1 illustrates the invention in the preferred embodiment. In the figures described above, similar reference numerals indicate similar or corresponding parts, in which reference numeral 1 indicates a typical valve which can opened or closed by a quarter of a turn; reference numeral 2 indicates the soap container apparatus with a lid; reference numeral 3 indicates a plurality of drainage holes; reference numeral 4 indicates a circular flat lid and female threaded ridge fixing element; reference numeral 5 indicates a ridge with a groove shaped and sized according to tap 1; reference numeral 6 indicates a male threaded stem; reference numeral 7 indicates hinges.

Figure 2:
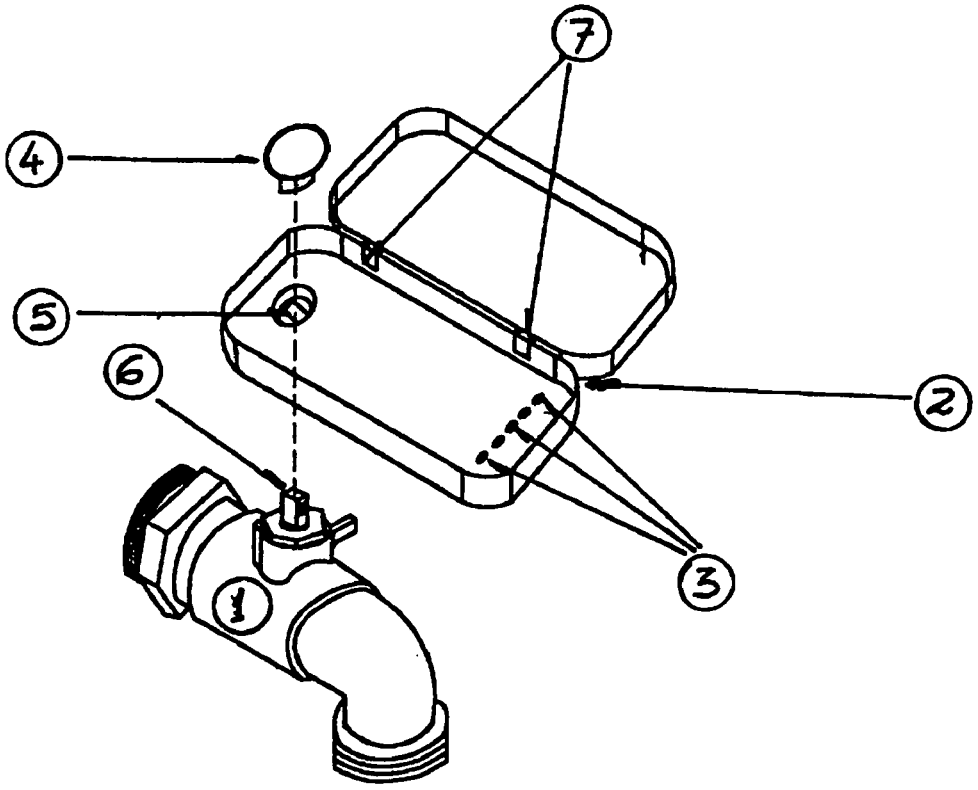
FIG. 2 illustrates a perspective exploded view of the components of the soap container apparatus showing the opened lid and its location with respect to the valve of the faucet.

As shown in FIG. 2, the preferred shape of the soap container apparatus is rectangular; however, other shapes such as oval, round, even triangular are acceptable. At the shorter axis end of rectangular shaped soap container apparatus 2 are a plurality of drainage holes 3 designed for draining the water left from the use of a bar of soap (not shown) are provided. On the opposite end, an outer ridge 5 is provided with a groove shaped and sized according to its insertion in the external upper section of the threaded shaft of the valve 1. The soap container apparatus 2 is fixed to valve 1 of the type discussed above by a flat lid 4 which has female thread that can be screwed onto the male threaded stem 6 of valve 1.

The handle or turning element (not shown) of valve 1 which is supplied by the manufacturer for closure or opening thereof in order is removed. The soap container apparatus 2 is attached via groove 5 to the male threaded stem 6, to subsequently hold in place via a fixing element which is a round flat lid and female threaded ridge 4.

Due to this attachment, when the user turns the soap container 2, to either side, the faucet via valve is opened or closed respectively and the soap is kept when closing the lid of the soap container with lid 2.

If desired, the manufacturer supplied handle (not shown) can be reinstalled by easily removing soap container apparatus 2 by unscrewing fixing element 4 from valve 1 and then reattaching the handle on male threaded stem 6.

The illustrated embodiments of the invention are intended to be illustrative only, recognizing that persons having ordinary skill in the art may construct different forms of the invention that fully fall within the scope of the subject matter disclosed herein. Other features and advantages of the invention will be apparent from the descriptions hereof.

What is claimed is:

1. A soap container apparatus for attachment to the male threaded stem of a valve of a faucet, said apparatus comprising:

a substantially rectangular base having an attachment end and a drainage end having a plurality of drainage holes;

a fixing element for attachment of the attachment end of said base to said valve at a ridge fixing element, wherein the bar soap after being used and placed in said base will have the water and soap residue remaining on the bar of soap to be drained out of said base via said drainage holes and wherein said apparatus can be used to turn said faucet on or off via said valve.

2. The soap container apparatus of claim 1 wherein said fixing element comprises a round flat lid and a female thread that corresponds to the male threaded stem of the valve.

3. The soap container apparatus of claim 2 wherein said base further comprises a hinged lid that substantially encloses said base when said lid is closed onto to said base thereby protecting the bar of soap contained therein.

* * * * *